US006739081B1

(12) United States Patent
Powers

(10) Patent No.: US 6,739,081 B1
(45) Date of Patent: May 25, 2004

(54) RESILIENT ROAD SIGN

(76) Inventor: Jim Powers, 2630 VanHorn Rd., Fairbanks, AK (US) 99709

( * ) Notice: Subject to any disclaimer, the term of this patent is extended or adjusted under 35 U.S.C. 154(b) by 0 days.

(21) Appl. No.: 10/125,652

(22) Filed: Apr. 18, 2002

(51) Int. Cl.[7] ..... G09F 7/00; G09F 7/18
(52) U.S. Cl. ..... 40/612; 40/607.01
(58) Field of Search ..... 40/602, 607, 608, 40/612, 605, 624, 606.15, 606.16, 607.01; D20/41

(56) References Cited

U.S. PATENT DOCUMENTS

| | | | | | |
|---|---|---|---|---|---|
| 1,674,565 | A | * | 6/1928 | Peterson | 40/613 |
| 2,033,024 | A | | 3/1936 | Burden | |
| 2,084,818 | A | * | 6/1937 | Neil | 40/613 |
| 3,521,390 | A | * | 7/1970 | Carlson | 40/602 |
| 3,526,200 | A | | 9/1970 | Doyle | |
| 3,646,696 | A | | 3/1972 | Sarkisian | |
| 3,777,428 | A | | 12/1973 | Caufield | |
| 3,899,843 | A | | 8/1975 | Doyle et al. | |
| 4,134,439 | A | * | 1/1979 | Scott | 160/135 |
| 4,686,785 | A | | 8/1987 | Obbermito | |
| 4,783,921 | A | | 11/1988 | George | |
| 4,909,464 | A | | 3/1990 | Levine et al. | |
| 5,152,091 | A | | 10/1992 | Leach | |
| 5,220,952 | A | * | 6/1993 | Beaulieu | 160/231.1 |
| 5,367,807 | A | * | 11/1994 | Van Beek | 40/606.14 |
| 5,375,641 | A | * | 12/1994 | Schlueter | 160/135 |
| 5,778,959 | A | * | 7/1998 | Guetschow | 160/231.2 |
| 5,819,449 | A | * | 10/1998 | Molson | 40/200 |
| 5,903,991 | A | * | 5/1999 | Sasse | 40/607.04 |
| 6,003,256 | A | | 12/1999 | Leach et al. | |
| 6,056,250 | A | | 5/2000 | Hillstrom et al. | |
| 6,237,883 | B1 | | 5/2001 | Levin et al. | |

FOREIGN PATENT DOCUMENTS

| | | | | |
|---|---|---|---|---|
| GB | 2261310 | * | 5/1993 | 40/607.11 |

* cited by examiner

*Primary Examiner*—Brian K. Green
(74) *Attorney, Agent, or Firm*—Sierra Patent Group, Ltd.

(57) ABSTRACT

A resilient road sign comprising a rigid center member having left and right wings resiliently attached to the center member. The left and right wings are comprised of a substantially rigid material. The left and right wings and the rigid center portion each have a front surface and a rear surface. The left and right wings and rigid center portion may all have written indicia on the front surfaces thereof.

5 Claims, 5 Drawing Sheets

RESILIENT ROAD SIGN

BACKGROUND

1. Field of the Invention

The present invention relates to road signs. Specifically the present invention relates to a road sign with resilient sides such that the sides can flex backwards or forwards then realign themselves with the rigid center portion of the road sign.

2. Prior Art

Numerous signs and sign stand devices have been designed for displaying information to the public. However, several problems are associated with these signs, especially road signs located in certain parts of the United States and the world.

In certain portions of the United States and the world, detrimental weather conditions exist during particular times of the year. In areas such as Alaska, snow is present during most of the year. When snow is present, machines are required to clear the streets on a regular basis so that people have access to the streets. Snowplows can cause great damage to street signs. The snowplow throws the snow with a large force onto the sides of the road. When the snow is thrown to the sides of the road with this kind of force, it can bend or even break metal signs with ease. Broken, bent or distorted signs are no longer readily visible to oncoming motorists.

In other parts of the United States and world, winds can do the same type of damage to road signs or any type of sign located in these areas. For instance, on the Eastern Coast of the United States hurricane force winds often hit the coastal cities with such strength as to do substantial damage to road signs located in those areas. Wind can bend and even break road signs and other types of signs.

To address these problems, some signs have been designed that could, conceivably, withstand weathering by the elements, especially the wind. One example of the such a sign is shown in U.S. Pat. No. 5,152,091 to Leach which discloses a collapsible highway sign that includes a cross brace assembly having first and second semi-flexible arms pivoted together. Each arm has first and second ends with four fastener stops. A sign sheet of flexible material with opposing message bearing and attachment faces as four fasteners secured to the attachment face. An anti-kiting device is secured to the sign to resist kiting and maintain the sign assembly in a safe position visible to oncoming traffic. Another example is in U.S. Pat. No. 3,899,843 to Doyle et al. which discloses a signaling device comprising a sign and a support with the sign being formed of flexible material and having rigid extension arms which are yieldably urged into position for supporting the sign. The rigid extension arms will bend with a predetermined wing load on the sign to facilitate spilling of wind past the sign. Means is provided which will prevent bending of the sign beyond a predetermined amount when wind is being spilled by the sign.

Yet another example is shown in U.S. Pat. No. 3,777,428 to Caufield et al. which discloses a signal apparatus for emergency use. The signal apparatus comprises a panel signal wherein panels incorporated therein are constructed to facilitate wind spillage in a manner such as to preclude the panel signal structure from tipping or blowing over in the presence of excessive wind pressures.

Hence, there is a need in the art for a resilient road sign which is able to withstand weathering by the elements or acting upon by other forces and maintain its original shape. The resilient road sign of the present invention serves as a rigid permanent or semi permanent resilient road sign that can be struck by snow, wind, vehicles or any other force, bend and resiliently spring back to its original form. There is also a need for a method of manufacturing a resilient road sign in which the resilient road sign is constructed from economical materials and easily assembled into the finished product.

SUMMARY OF THE INVENTION

A resilient road sign having a center member adapted for attachment to a support member and left and right wings resiliently attached to the center member.

DETAILED DESCRIPTION OF THE INVENTION

Those of ordinary skill in the art will realize that the following description of the present invention is illustrative only and not in any way limiting. Other embodiments of the present invention will readily suggest themselves to such skilled persons.

Figure 1:
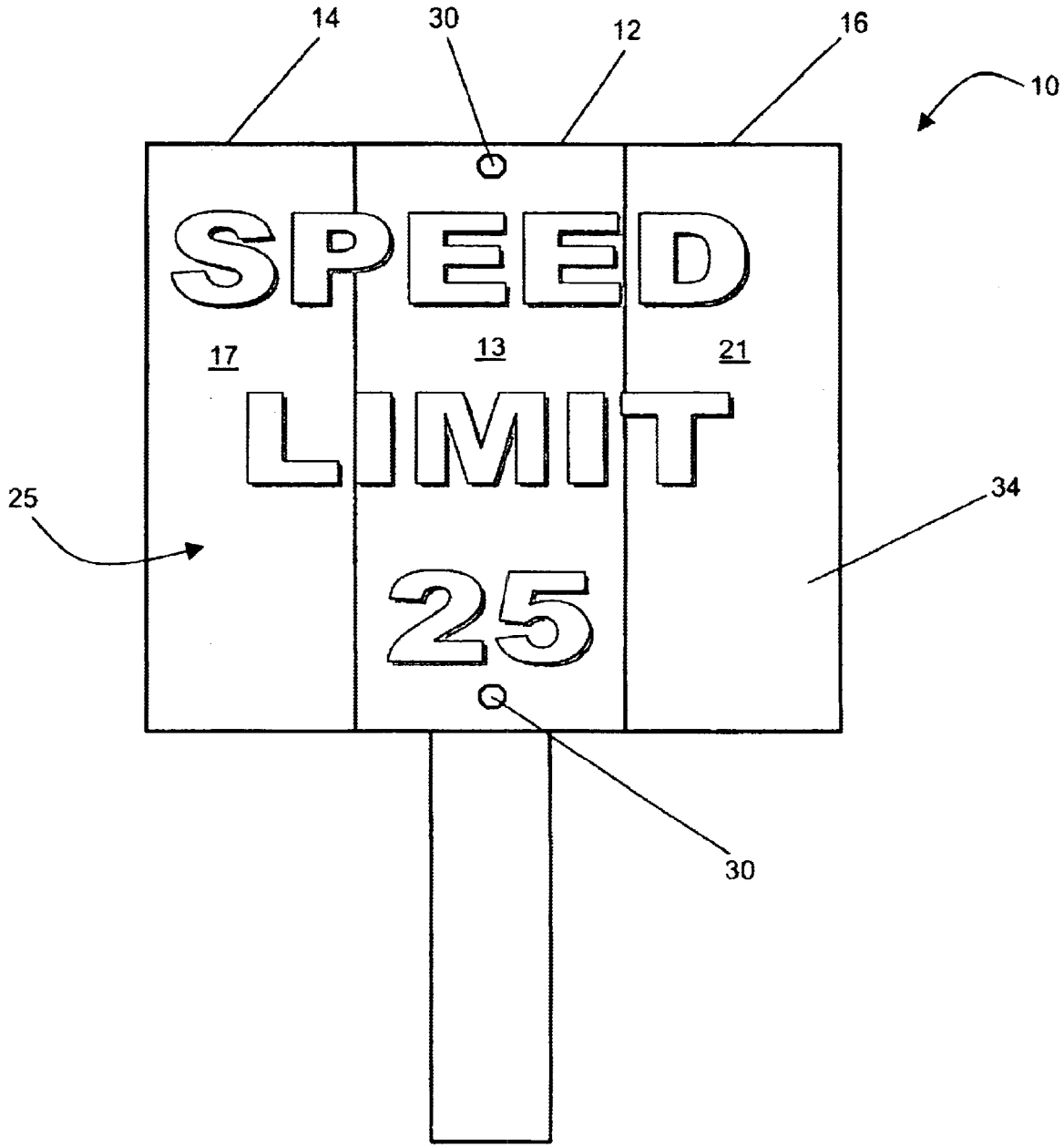
FIG. 1 shows a frontal view of the resilient road sign of the present invention.

FIG. 1 discloses a resilient road sign. Resilient road sign 10 has a rigid center member 12 having a front surface 13 and a back surface 15, a right wing 14 having a front surface 17 and a back surface 19 and a left wing 16 having a front surface 21 and a back surface 23. Rigid center member 12, right wing 14 and left wing 16 have written indicia 25 on the front surfaces 13, 17, 21, which designates the message portion of the sign. Rigid center member 12, right wing 14 and left wing 16 may be made out of any rigid material known in the art to be useful for such purposes such as 080, .100 o .125 5052-h38 conversion coated or alidined aluminum.

Figure 2:
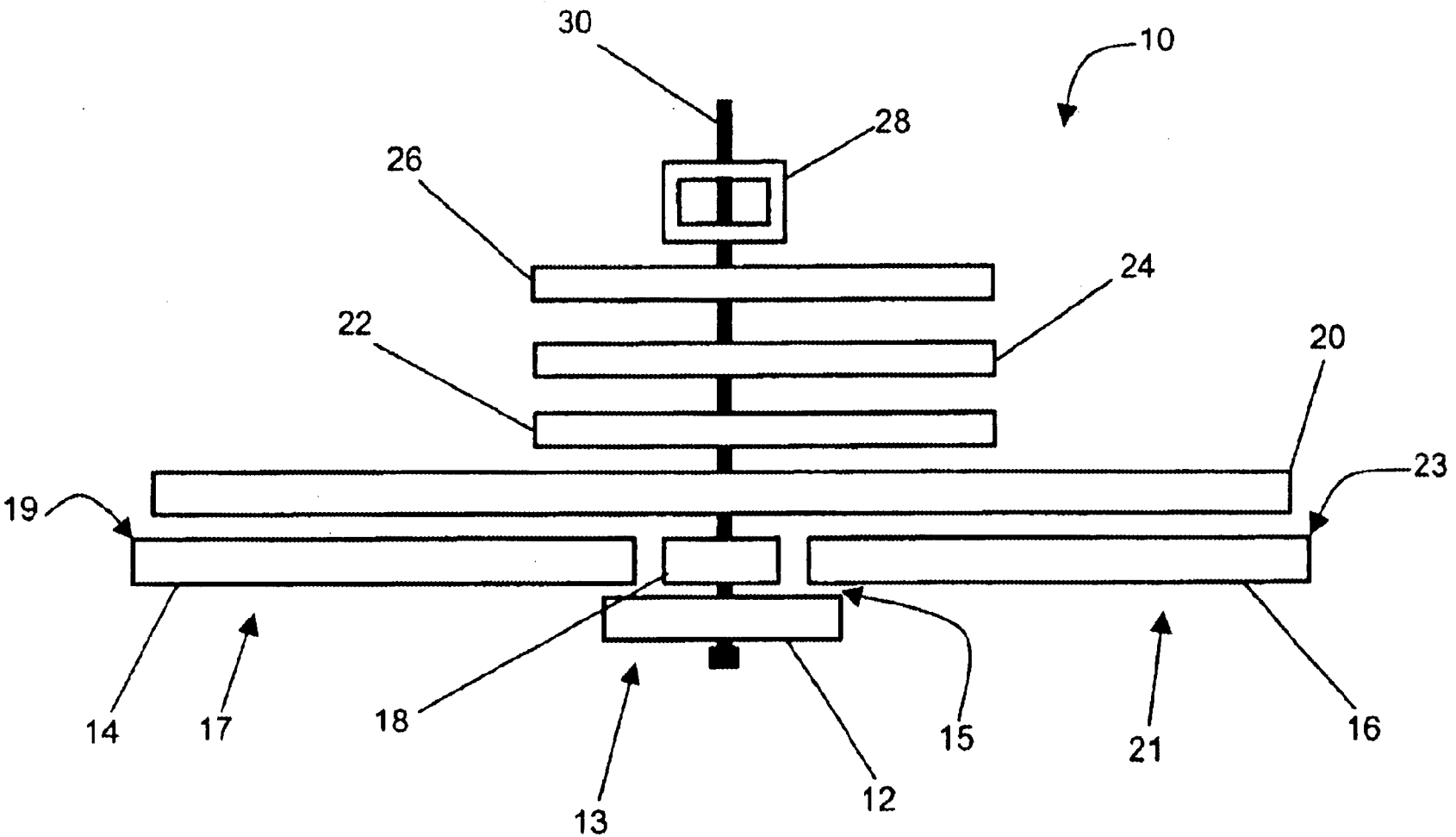
FIG. 2 shows a top perspective view of the resilient road sign of FIG. 1.

FIG. 2 discloses a top view of the resilient sign of the present invention. As disclosed in FIG. 2, rigid center member 12 overlays right wing 14 and left wing 16 by approximately ½ inch to 1 inch. However, depending on the size of the sign, the size of rigid center member 12, right wing 14 and left wing 16, the distance by which rigid center member overlaps right wing 14 and left wing 16 can vary greatly. Thus, the distance mentioned above is illustrative only and not meant in any way to be limiting.

As shown in FIG. 2, a rigid center strength member 18 having a front surface and rear surface is positioned at the center back surface of rigid center member 12 such that the rear surface of rigid center member 12 is adjacent to the front surface of rigid center strength member 18. Rigid center strength member 18 may be approximately 1 inch wide and the length of rigid strength center member 18 corresponds to the length of resilient road sign 10. As stated above, depending on the size of resilient road sign 10, the width of rigid center strength member 18 can vary greatly. Thus, the width mentioned above is illustrative only and not meant in any way to be limiting.

Referring still to FIG. 2, adhered to and extending across the entire surface of right wing 14, rigid center strength member 18 and left wing 16 may be a resilient material 20. Resilient material 20 can be made from any resilient material such as Lexan 8A35 and other like materials. Resilient material 20 connects right wing 14, rigid center strength member 18 and left wing 16. Resilient material 20 is adhered to right wing 14, rigid center strength member 18 and left wing 16 by any adhesives known in the art such as super high tack adhesive—either roll type or spray type, which may be highly resistant to detrimental whether conditions.

In one aspect of the present invention, a plurality of pieces of resilient material such as Formex GK-40 flame retardant polypropylene or other similar material, illustrated by numerals 22, 24 and 26, are attached approximately to the center of resilient material 20 by a fastener 30. Fastener 30 can be any type of attachment means such as a screw, bolt, rivet, pin, nail, etc. Fastener 30 provides attachment of rigid center member 12, rigid center strength member 18, resilient material 20, and plurality of resilient material pieces 22, 24 and 26, and pole 28 for placing resilient road sign 10 in the appropriate location.

In another aspect of the present invention, springs, such as leaf springs may be used instead of or together with resilient material 20 and the plurality of resilient materials pieces 22, 24 and 26. Further, in another embodiment, the sign itself may be comprised of a large leaf spring.

In yet another aspect of the invention, the front surface of rigid center member 12, right wing 14 and left wing 16 and the rear surface of resilient material 20 is covered (coated) with a film (non-stick material)34 to prevent foreign materials such as snow and ice to stick to the surface of resilient road sign 10 and thus preventing resilient road sign 10 to assume its original state once it has been hit by snow, ice, etc. The non-stick material 34 can be any material known in the art suitable for such purposes such as crystal coat spray coating or Avery Dennison Graphitti film.

Figure 3:
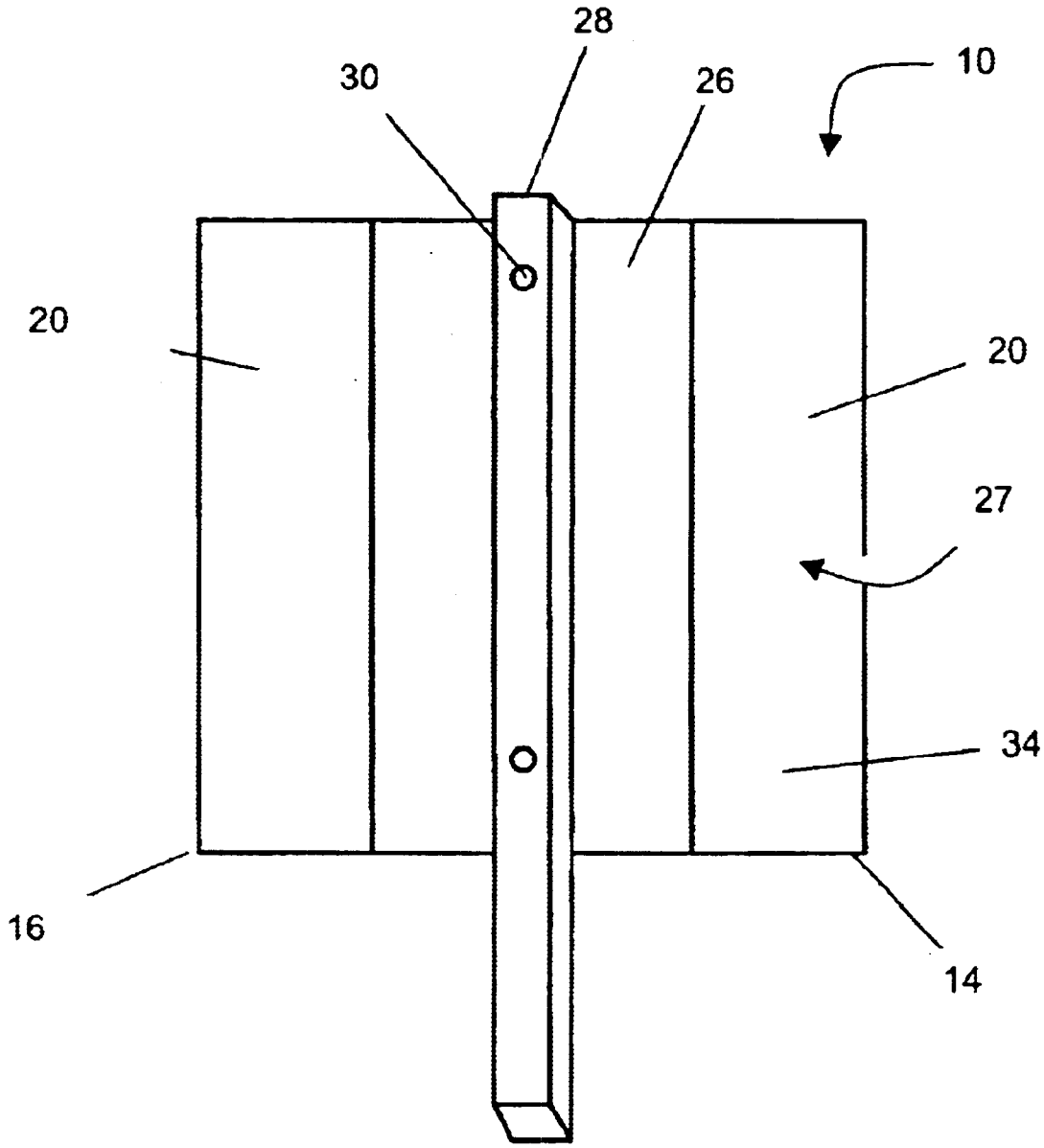
FIG. 3 shows a rear view of the resilient road sign of FIG. 1.
Figure 4A:
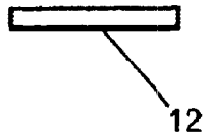
FIGS. 4*a*–4*e* show a method of manufacturing the resilient road sign of FIG. 1.
Figure 4B:
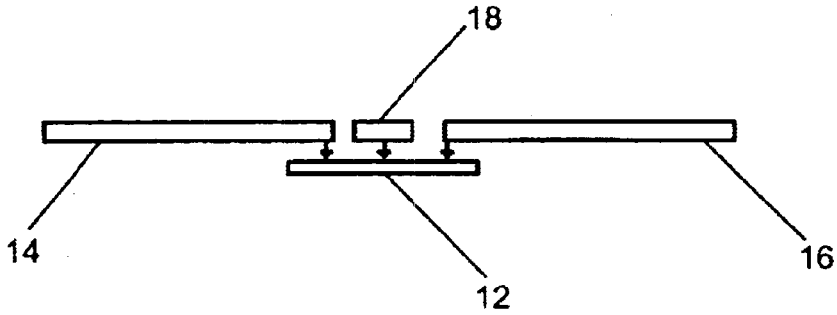
Figure 4C:
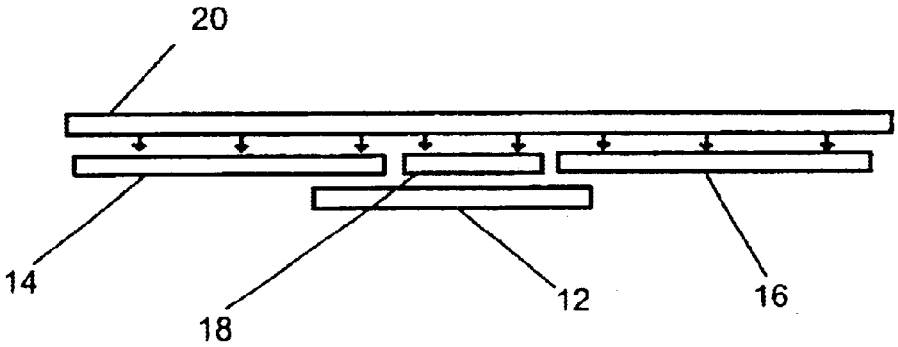
Figure 4D:
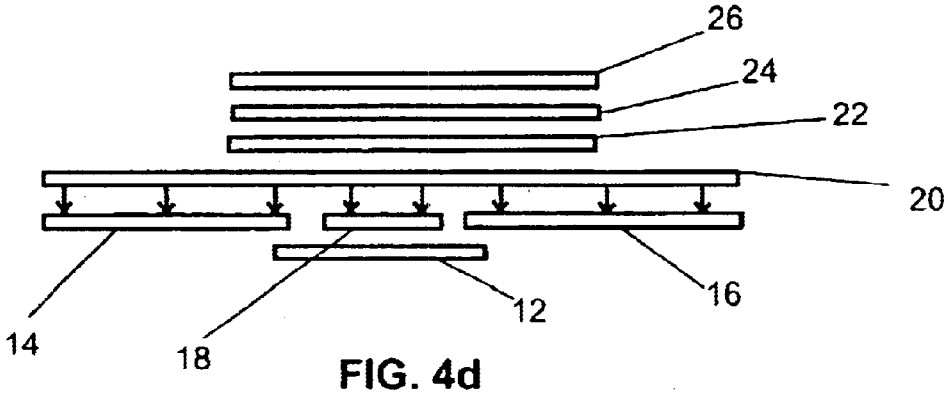
Figure 4E:
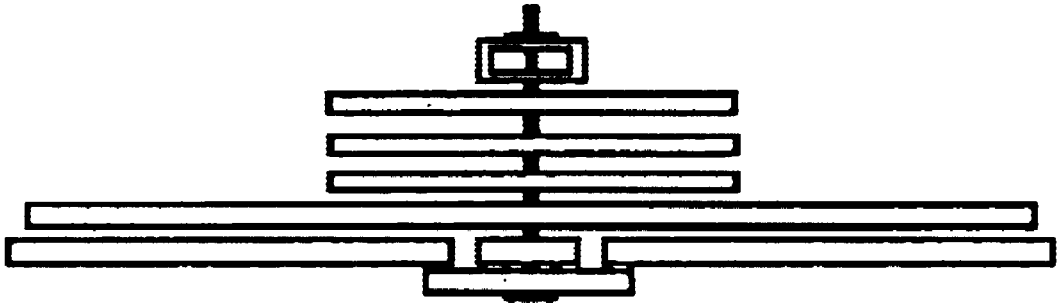

FIG. 3 discloses a rear view of resilient road sign 10. As shown in FIG. 3 resilient material 20 covers, not necessarily all, but most of right wing 14 and left wing 16. The plurality of resilient pieces 22, 24 and 26 indicated in FIG. 3 by resilient material piece 26 are attached to resilient road sign 10 and pole 28 by fastener 30.

In yet another aspect of the invention, as shown in FIGS. 4*a* through 4*e*, a method of manufacturing the resilient road sign 10 of the present invention is disclosed. As shown in FIG. 4, a method of manufacturing resilient road sign 10 begins with providing rigid center member 12. Next a rigid center strength member 18 is placed at or near the center of rigid center member 12. Next right wing 14 is placed at or near the right side of rigid center member 12 overlapping the rigid center member 12. Next left wing 16 is placed at or near the left side of rigid center member 12 overlapping the rigid center member 12.

Resilient material 20 is the adhered to the rear surface of right wing 14, left wing 16 and rigid center strength member 18. Next a plurality of resilient material pieces 22, 24 and 26 are placed at or near the center of resilient material 20. Finally, the plurality of resilient pieces 22, 24 and 26, resilient material 20 rigid center strength member 18 and rigid center member 12 are attached together by fastener 30.

In another method of manufacturing the present invention, springs such as leaf springs may be used instead of or together with resilient material 20 and the plurality of resilient materials pieces 22, 24 and 26.

While embodiments and application of this invention have been shown and described, it would be apparent to those skilled in the art that more modifications that mentioned above are possible without departing from the inventive concepts herein. The invention, therefore, is not to be restricted except in the spirit of the appended claims.

I claim:

1. A resilient road sign comprising:

a rigid center member having a front center surface and a back center surface opposite said front center surface;

a right wing resiliently coupled to said rigid center member, said right wing having a front right surface and a rear right surface opposite said front right surface;

a left wing resiliently coupled to said rigid center member, said left wing having a front left surface and a rear left surface opposite said front left surface, wherein said rigid center member overlaps said right wing and said left wing;

a rigid center strength member coupled to said back center surface of said rigid center member and disposed between said right wing and said left wing;

a resilient material coupled to said rigid center strength member opposite said rigid center member, and coupled to said right back surface of said right wing and coupled to said left back surface of said left wing;

at least one resilient material piece coupled to said resilient material opposite said rigid center strength member, said at least one resilient material piece configured to bias said right wing and said left wing;

an indicia disposed on said front center surface, said front right surface and said front left surface;

at least one fastener disposed through said rigid center member, said rigid center strength member, said resilient material and said at least one resilient material piece, said at least one fastener configured to couple the resilient road sign to a pole.

2. The resilient road sign of claim 1 further comprising:

a non-stick material disposed on said front center surface, said front right surface and said front left surface.

3. The resilient road sign of claim 1 further comprising:

a non-stick material disposed on said front center surface, said front right surface and said front left surface and a rear surface of said resilient material.

4. The resilient road sign of claim 1 wherein said back center surface contacts a portion of said front right surface and a portion of said front left surface.

5. The resilient road sign of claim 1 wherein said at least one resilient material piece comprises a plurality of resilient materials stacked in layers configured to bias said right wing and said left wing against said rigid center member and configured to flex in response to a load applied to at least one of said right wing and said left wing.

* * * * *